United States Patent [19]

Aker

[11] Patent Number: 4,543,900

[45] Date of Patent: Oct. 1, 1985

[54] SHIPBOARD ICE LUBRICATION SYSTEM AND JET PUMP FOR USE THEREIN

[75] Inventor: Charles M. Aker, Santa Fe Springs, Calif.

[73] Assignee: Omnithruster, Inc., Santa Fe Springs, Calif.

[21] Appl. No.: 590,593

[22] PCT Filed: May 20, 1983

[86] PCT No.: PCT/US83/00813

§ 371 Date: Jan. 23, 1984

§ 102(e) Date: Jan. 23, 1984

[87] PCT Pub. No.: WO83/04232

PCT Pub. Date: Dec. 8, 1983

Related U.S. Application Data

[63] Continuation-in-part of Ser. No. 380,522, May 21, 1982.

[51] Int. Cl.[4] ..... B63B 1/38

[52] U.S. Cl. ..... 114/40; 114/67 A; 417/198

[58] Field of Search ..... 114/40, 67 A, 41, 42, 114/67 R, 151; 417/194, 197, 198, 157, 171, 160; 405/60, 61; 440/44

[56] References Cited

U.S. PATENT DOCUMENTS

| | | | |
|---|---|---|---|
| 2,764,954 | 10/1956 | Oeltgen | 114/67 A |
| 2,954,750 | 10/1960 | Crump et al. | 114/67 A |
| 3,273,333 | 9/1966 | Roulund | 440/44 |
| 4,029,035 | 6/1977 | German | 114/40 |

FOREIGN PATENT DOCUMENTS

| | | | |
|---|---|---|---|
| 8028249 | 3/1981 | Fed. Rep. of Germany | 114/40 |
| 1500746 | 2/1978 | United Kingdom . | |
| 510414 | 4/1976 | U.S.S.R. | 114/40 |

OTHER PUBLICATIONS

Schutte & Koerting Co., Bulletin #4-P, Jet Catalog, pp. 4401-4416, Aug. 1934.

*Primary Examiner*—Galen L. Barefoot
*Assistant Examiner*—Edwin L. Swinehart
*Attorney, Agent, or Firm*—Freilich, Hornbaker, Rosen & Fernandez

[57] ABSTRACT

An ice lubrication system for easing the passage of a ship through ice laden waters. A pressurized flow of water passes through a nozzle into the inlet of a mixing chamber comprising a venturi where gas from a gas manifold is mixed with the water. The effect of the venturi is to first cause the gas to mix into the water flow and, after passage of the flow through the venturi, to cause the gas to emerge from the water. A frothy combination of gas bubbles and water is thus created which is discharged through openings in the ship's hull below the waterline. Once discharged, the gas and water combination rises up the side of the hull to provide separation and lubrication between the hull and floating ice.

10 Claims, 12 Drawing Figures

SHIPBOARD ICE LUBRICATION SYSTEM AND JET PUMP FOR USE THEREIN

This application is a continuation-in-part of applicant's previously filed application, Ser. No. 380,522, filed May 21, 1982.

FIELD OF THE INVENTION

This invention relates generally to improvements in jet pumps and shipboard ice lubrication systems utilizing such pumps for facilitating the movement of a ship through ice laden water.

BACKGROUND OF THE INVENTION

The presence of ice in navigable waters impedes the progress of ships therethrough because of, among other things, friction created by the hull of a ship rubbing against large pieces of ice. A variety of ice lubrication systems for reducing such friction have been proposed. For example, U.S. Pat. No. 3,665,886 describes means for discharging heated water from above the water line of the ship to melt ice proximate thereto, and U.S. Pat. Nos. 3,580,204 and 4,029,035 describe pump and pipe arrangements designed to blow compressed air or other gases through openings in a ship's hull below the waterline. The gas so discharged rises alongside the hull, creating a ridge of gas and water between the hull and the ice. Such prior art devices typically require means for compressing the gases and/or heating the water utilized by the system.

SUMMARY OF THE INVENTION

The present invention is directed to an improved ice lubrication system for a ship for facilitating its passage through ice strewn water and to an improved jet pump suitable for use in such an ice lubrication system.

In accordance with one aspect of the present invention, an improved jet pump is provided which efficiently utilizes a liquid flow, e.g. water, to entrain a gas, e.g. air, to discharge a mixture having a relatively high gas/liquid ratio. In accordance with the invention, a vortex generating means is incorporated in the jet pump inlet to impart a controlled rotational motion to the surface of the liquid stream flowing into the jet pump suction chamber. The liquid stream, exiting at a high velocity from the inlet nozzle, lowers the pressure in the suction chamber to draw gas from a supply source coupled thereto. The surface turbulence of the stream increases the ability of the liquid to capture and transport the gas while also reducing the back pressure on the stream.

In accordance with a different aspect of the present invention, an improved shipboard ice lubrication system is provided including means for discharging a liquid/-gas mixture through openings in the ship's hull, preferably located below the waterline, to wet the hull/fractured ice interface to reduce friction therebetween and thus facilitate movement of the ship through ice laden waters.

In a preferred embodiment of the shipboard ice lubrication system, a plurality of jet pumps are provided, each having its discharge port mounted adjacent to a different opening in the ship's hull. The jet pumps are supplied by a pressurized water source and an air source. The pressurized water source includes a liquid manifold which is supplied by a water pump drawing water from the sea.

In accordance with one feature of the preferred embodiment, the vortex generating means in each jet pump comprises a plurality of vanes oriented around the inner periphery of the inlet nozzle to rotate the surface of the liquid stream passing therethrough while permitting waterborne debris and ice to move through the nozzle's central axial region without clogging.

In accordance with another feature of the invention, the air drawn by the jet pump suction ports can be comprised of exhaust gases produced by the ship's machinery, such as the primary or auxiliary engines.

In accordance with a further feature of the preferred embodiment, the suction chamber of each jet pump is coupled to a manifold having an air entrance opening adjacent the ship's hull above the waterline and a valve is provided to enable the water stream exiting from the jet pump inlet nozzle to be discharged through the air entrance opening to facilitate snow removal from floating ice blocks.

In accordance with a still further feature of the preferred embodiment, the aforementioned ice lubrication system is associated with a directional thruster system enabling the same water pump to supply water to both systems.

DETAILED DESCRIPTION

Figure 1:
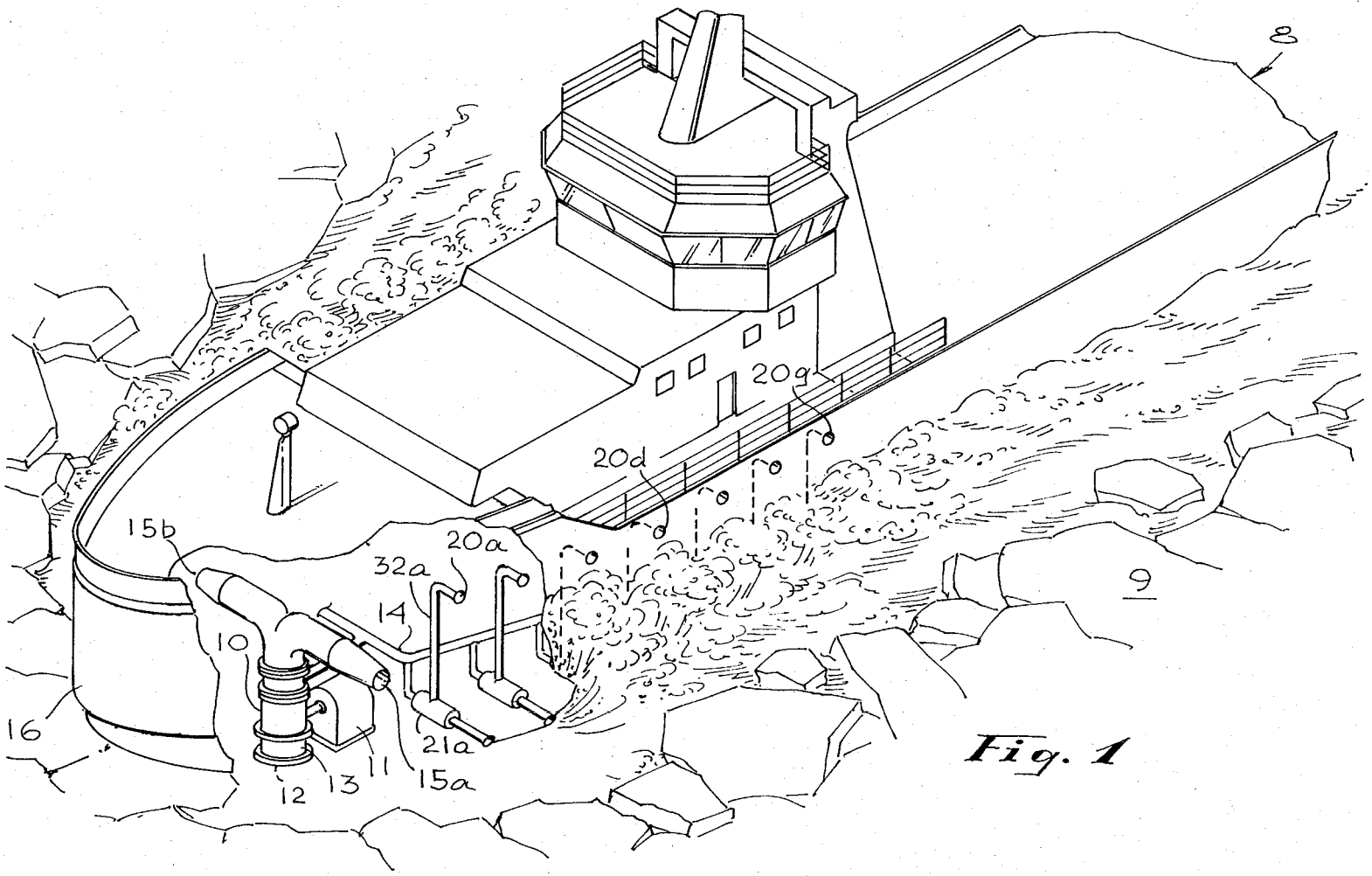
FIG. 1 is an isometric view, partially broken away, of a vessel incorporating an ice lubrication system in accordance with the invention shown in combination with a boat thruster system.

FIG. 1 depicts a ship 8 passing through a body of water wherein large pieces of ice 9 are present. In accordance with the preferred embodiment, the ship 8 includes a thruster system mounted within its hull 16 for propelling and/or maneuvering the ship. In accordance with the invention, an ice lubrication system for easing the passage of the ship 8 through ice laden water is also mounted within hull 16 and is interconnected with the thruster system to receive water pumped thereby. Exemplary thruster systems are disclosed in U.S. Pat. Nos.

4,056,073 and 4,214,544 and will not be explained in detail herein.

Basically, the thruster system depicted in FIG. 1 utilizes a water pump 10 driven by motor 11 to draw water from the sea through water inlet 12 and pipe 13. The drawn water may then be discharged through thruster outlets 15*a* and/or 15*b*, or through the ice lubrication system via liquid manifold (or conduit) 14.

The preferred embodiment of the ice lubrication system utilizes pump 10 to provide a water supply to manifold 14. Manifold 14 supplies a flow of water to two sets of jet pumps 21*a*–21*x* (FIG. 3A) spaced along the port and starboard sides of the ship. The jet pumps operate to entrain a gas (air herein), drawn through inlets 20*a*–20*x* (FIG. 3B) in the water flow discharged by the jet pumps through opening 23*a*–23*k*. The air can be drawn directly from the environment or, if desired, it can be heated by being drawn over warm machinery and/or can consist in part of exhaust gases drawn from the ship's machinery, such as the primary or auxiliary engines (not shown). The liquid/gas mixture produced by jet pumps 21*a*–21*x* is discharged to the sea through hull discharge openings 23*a*–23*x* located below the chine of the ship. Since each of the jet pumps is essentially identical, the operation of the system will now be explained in greater detail in terms of the operation of a representative jet pump 21.

Figure 2:
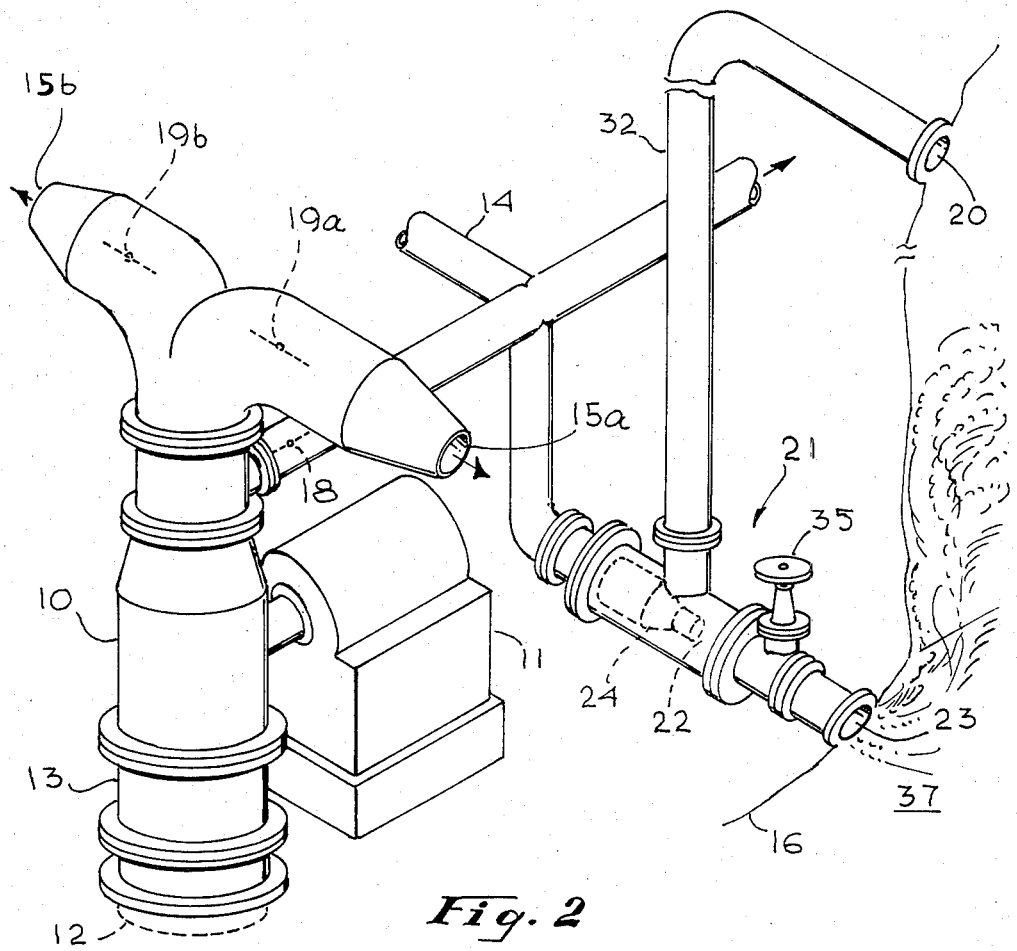
FIG. 2 is an isometric view depicting a portion of FIG. 1 in greater detail.

FIG. 2 provides a more detailed view of a representative portion of the ice lubrication system of FIG. 1. Jet pump 21, comprising suction chamber 22 and nozzle 24 receives the water flow from manifold 14. The water flow is accelerated through converging nozzle 24 and discharged into suction chamber 22 wherein air supplied through conduit 32 is entrained with the water flow. The liquid/gas mixture so produced is then discharged through hull discharge opening 23, preferably below the waterline of the ship. After discharge, the mixture rises to the water surface to lubricate the interface between the hull 16 of the ship 8 and the ice 9.

Figure 3A:
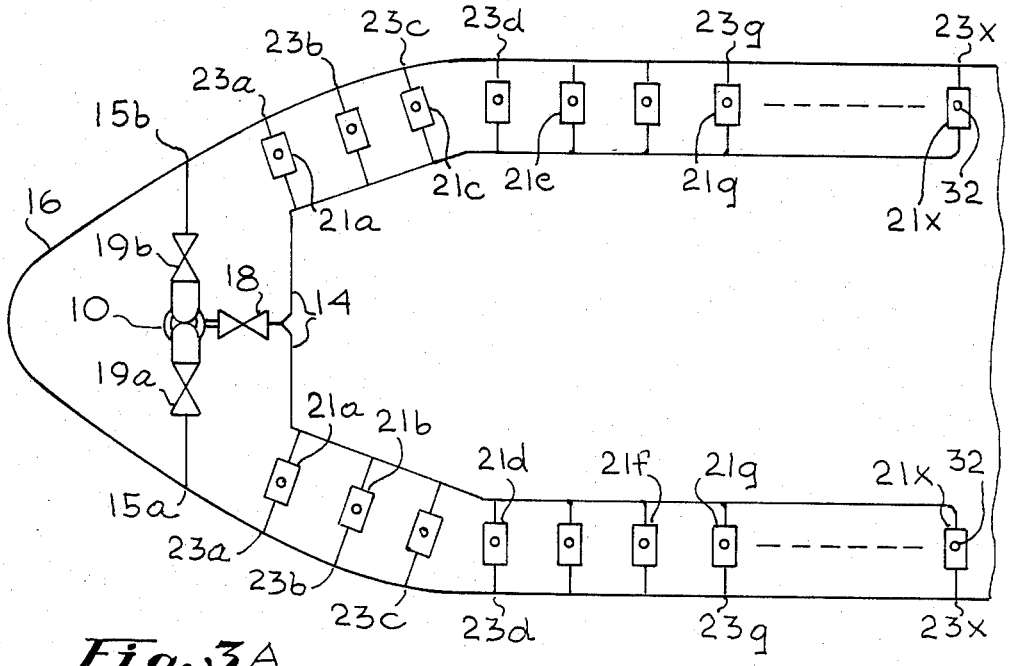
FIG. 3A is a schematic plan view of the ice lubrication system of FIG. 1 depicting the orientation of multiple hull openings.
Figure 3B:
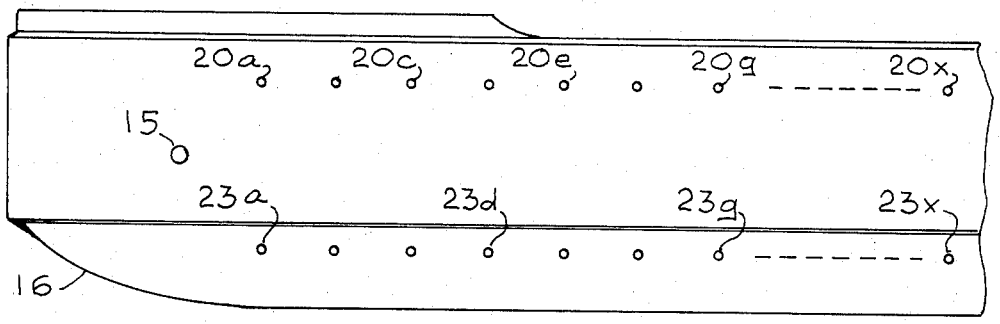
FIG. 3B is a schematic side elevation view of the hull of the ship depicted in FIG. 3A.

FIG. 3A provides a plan view of an ice lubrication system comprising a plurality of jet pumps 21*a*–21*x* and discharge openings 23*a*–23*x* dispersed along the port and starboard sides of a ship. The relative placement of air inlets 20*a*–20*x* in the preferred embodiment is shown in FIG. 3B.

The ice lubrication system of the preferred embodiment may be operated with or without simultaneous operation of the thruster system. If the two systems are operated concurrently, the output of pump 10 is shared therebetween. The pump 10 should be selected to have sufficient capacity to provide the required water flow for simultaneous operation of both the thruster and ice lubrication systems.

Figure 4A:
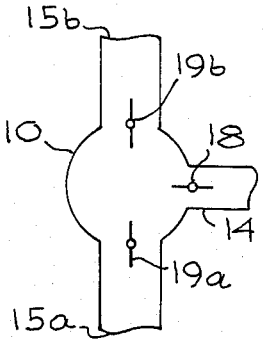
FIG. 4A is a schematic representation of the control valves of FIG. 2 configured for simultaneous thruster and ice lubrication operation.
Figure 4B:
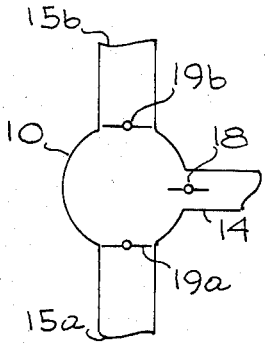
FIG. 4B is a schematic representation of the control valves of FIG. 2 configured for ice lubrication operation only.
Figure 4C:
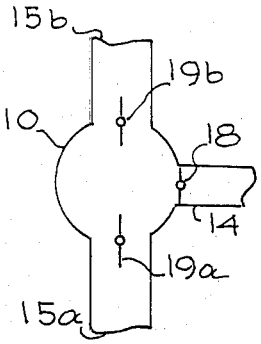
FIG. 4C is a schematic representation of the control valves of FIG. 2 configured for thruster operation only.

FIGS. 4A, 4B and 4C depict the basic thruster ice lubrication system control valve configurations wherein valve 18 controls the flow of water through conduit 14 and valves 19*a* and 19*b* control the flow of water through thruster outlets 15*a* and 15*b* respectively. In FIG. 4A, both the thruster and ice lubrication systems are operating and each of valves 18, 19*a* and 19*b* are open to allow water flow therepast. In FIG. 4B, the thruster system is not operating, indicated by valves 19*a* and 19*b* being closed, and the ice lubrication system is operating, indicated by valve 18 being open. Finally, FIG. 4C depicts the condition wherein the thruster system is operating, indicated by valves 19*a* and 19*b* being open and the ice lubrication system is not operating, indicated by valve 18 being closed. Of course, either of valves 19*a* or 19*b* may be opened or closed independently of the other to provide side thrust for the vessel regardless of the position of valve 18.

A typical ice lubrication system as described hereinabove could require a water flow on the order of 32,000 gallons per minute to supply 15–20 port and 15–20 starboard hull openings each approximately 4 inches in diameter. Such openings are typically spaced every six to nine feet in the forepart of the hull. The power required by such a system could be expected to be on the order of 600 horsepower. The system parameters including flow rate, number of openings, etc., of course, depends on the size of the vessel and the desired pattern for the air/water stream. Representative systems are designed to lubricate the forward one-third of a vessel's hull.

Figure 5:
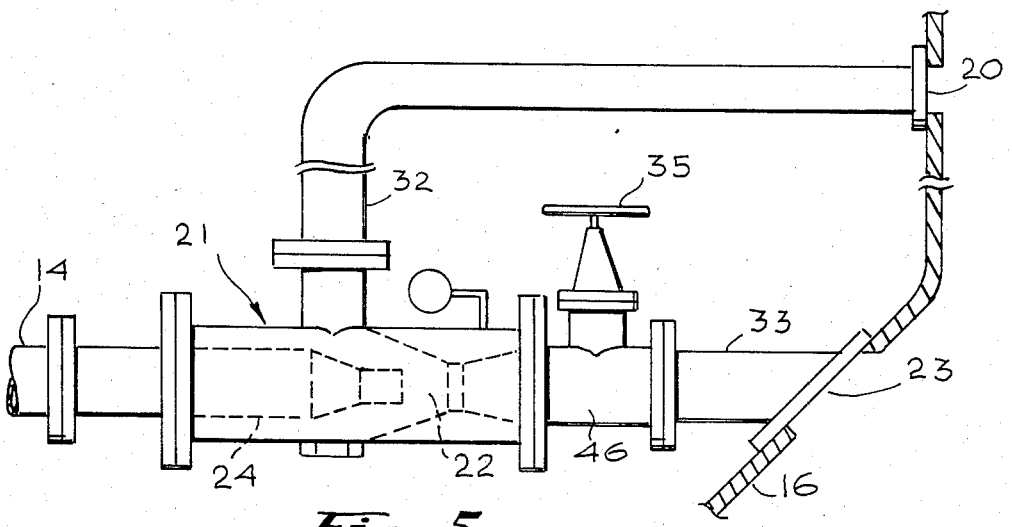
FIG. 5 is a side view of a single jet pump and related structure.

FIG. 5 depicts an embodiment of the invention wherein the discharge flow from jet pump 21 passes through valve 46, preferably a gate valve, before being discharged to the sea. Valve 46 is normally open during ice lubrication system operation, but may be closed as by manipulation of valve control 35 when the system is not in use to prevent sea water from entering the system through hull discharge opening 23. Valve 46 may also be closed during operation in order to force water flowing through jet pumps 21 upward through conduit 32 and overboard through air inlet 20 in order to wash accumulated snow from the ice sheet adjacent the vessel's hull. Such washing away of the snow aids the lubrication process.

Figure 6:
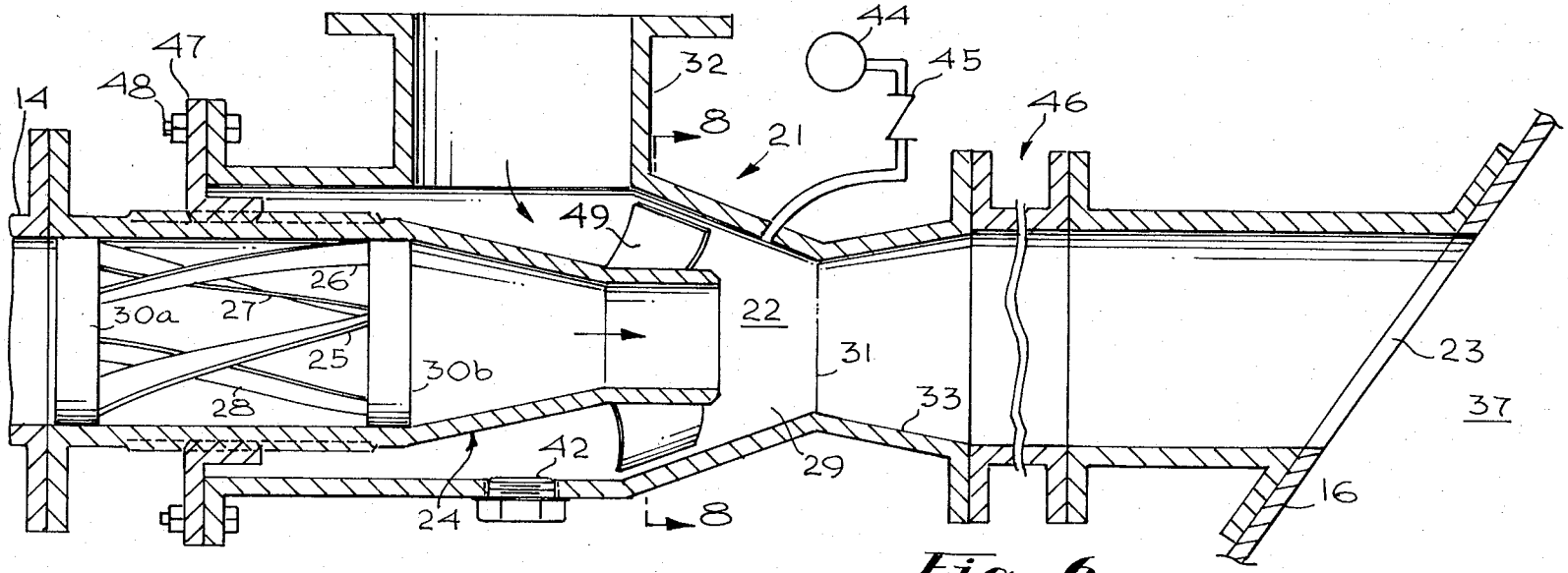
FIG. 6 is a sectional view depicting a jet pump and discharge apparatus in accordance with the invention.
Figure 8:
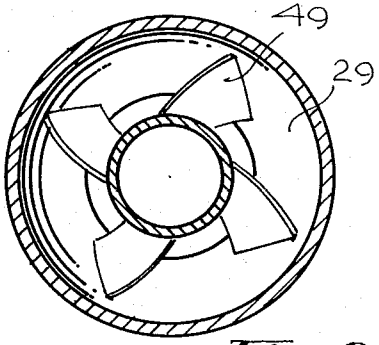
FIG. 8 is a sectional view taken substantially along the plane 8—8 of FIG. 6.

FIG. 6 illustrates a preferred embodiment of an improved jet pump in accordance with the invention. The pump inlet receives water from manifold 14 which flows through nozzle 24 and is discharged into suction chamber 22. A preferred vortex generator, comprising vanes 25, 26, 27 and 28, is inserted within nozzle 24 in order to impart a swirl or rotational component to the surface of the water flow passing therethrough. In the preferred embodiment, such vanes define planar surfaces extending from a position proximate the inner surface of nozzle 24 into the water flow path and are oriented so as to define an acute angle with the longitudinal axis of the nozzle thereby deflecting the water from its axial flow direction to introduce a swirl component thereto. The resulting turbulence tends to increase the aeration of the water and improve the spread pattern of the water/air mixture discharged through opening 23. As depicted in FIG. 6, the vanes project only part way into the flow path through nozzle 24 leaving a path along the central axis thereof for the unimpeded passage of debris and ice. The likelihood of nozzle 24 becoming clogged is thus reduced.

Figure 7:
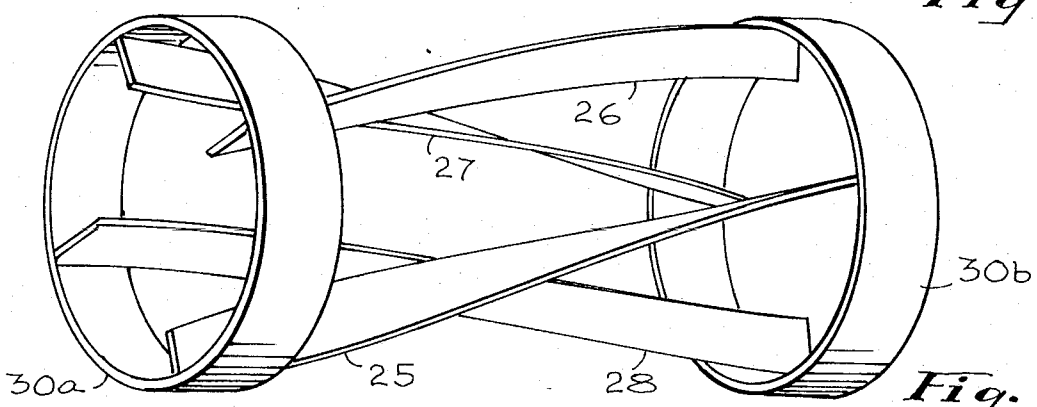
FIG. 7 is an isometric view of a vortex generating means in accordance with the invention.

The vortex generator of the preferred embodiment is depicted in FIG. 7. Vanes 25, 26, 27 and 28 comprise essentially planar members which are affixed at each end to ring housings 30*a* and 30*b*. Ring housings 30*a* and 30*b* are shaped so as to be insertable within nozzle 24 as depicted in FIG. 6. As shown in FIG. 7, the vanes are twisted by a predetermined amount to achieve a desired amount of vortex (or swirl) generation. Undesired movement of the vanes within the nozzle is prevented by bolting, keying or otherwise securing the vortex generator to the inside surface of the nozzle.

Additional or alternative elements can be employed within the nozzle 24 to facilitate the introduction of surface swirl components into the water flow. For example, studs or other projecting spoiler elements can be mounted on the nozzle inner periphery to extend into and influence the water flow surface. Regardless of the particular manner of configuring the vortex generator, the inwardly projecting elements thereof are arranged to introduce a desired degree of turbulence in order to maximize air entrainment while also reducing the back pressure on the water stream exiting from the nozzle 24.

In accordance with the Bernoulli Principle, the stream of water emanating from nozzle 24 and flowing through suction chamber inlet 29 tends to lower the pressure in the vicinity of the moving stream as air molecules in inlet 29 are carried away by the stream. Thus, air via conduit 32 is drawn into the suction chamber inlet 29 where it is captured by and entrained in the water stream. The aerated water stream accelerates and the static pressure thereof decreases as it passes through jet pump throat 31 into discharge port 33 which acts as a diffuser for the air/water mixture. The discharge port 33 is connected to hull discharge opening 23 and therefore communicates with the underwater ocean environment 37. Pressure/velocity transitions taking place in the mixture stream proximate jet pump discharge port 33 are therefore taking place adjacent hull discharge opening 23. The passage of the air/water mixture from the jet pump throat 31 into the discharge port 33 results in a reduction in the velocity of the air/water mixture flow and a concurrent increase in the static pressure thereof. The combination of water and air emanates from the opening 23 in the hull of the ship and migrates upwardly alongside the outer surface of hull 16. The buoyance of the entrained air bubbles tends to accelerate the air/water mixture vertically, creating a surface effervescence or frothing action which aids in wetting and thus lubricating the interface between the hull and the ice sheet. In the preferred embodiment, the hull openings are preferably located below the chine or intersection of the sides and the bottom of the ship.

In the preferred embodiment, the outer surface of nozzle 24 is threaded so as to threadably engage flange 47. Flange 47 may be engaged with the housing of suction chamber 22 by bolts 48. Since varying the projection of nozzle 24 into suction chamber inlet 29 tends to control the degree of aeration of the water stream, nozzle 24 may be screwed into flange 47 until it projects the desired distance into inlet 29. The distance of such nozzle projection is determined by consideration of the air/water ratio desired in the mixture. Thus, varying the projection of nozzle 24 into the mixing chamber acts to vary the air/water ratio. The position of the nozzle is, however, typically fixed during initial installation of the system.

In order to further enhance the air/water mixing, it can be advantageous in some embodiments to also include vanes 49 upstream from the chamber 22 to impart a swirl component to the entering air stream.

Each suction chamber is provided with a drain 42 as depicted in FIG. 6. The purpose of drain 42 is to allow removal of residual water from the chamber during periods of system inactivity to prevent freeze-up. A source of compressed air 44 is also connected to suction chamber 22 via check valve 45 close to the exit of nozzle 24. The air source 44 can be selectively operated to assist in removal of any material such as ice or other debris which could clog the nozzle exit during operation.

Although the disclosed preferred ice lubrication system has been depicted as operating in conjunction with a thruster system, it should be recognized that the ice lubrication system finds independent utility and need not be used in conjunction with a thruster system. It is also pointed out that the jet pump disclosed herein, although well suited to the ice lubrication application, finds independent utility for mixing various liquids and gases.

It should also be noted that the system as described hereinabove affords sound absorption or masking tending to prevent detection of the ship; i.e. the air/water mixture has a lower sound propagation velocity than either air or water alone. Thus, operation of the ice lubrication system provides effective masking of sound produced by various machinery on the ship and also reduces the liklihood of detection by the use of sonar techniques.

Figure 9:
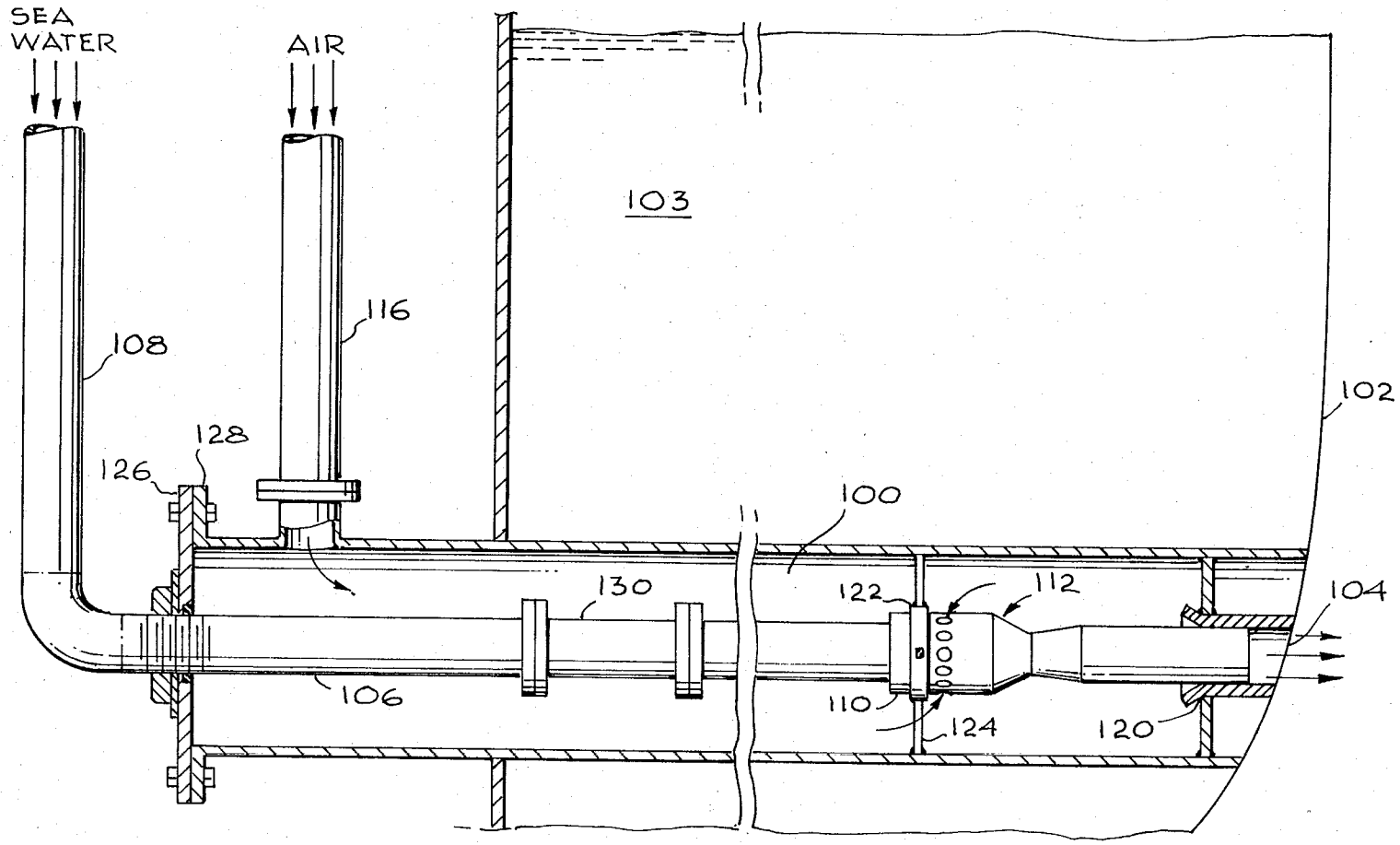
FIG. 9 is a sectional view depicting an alternative embodiment of the invention incorporating acoustic absorber means.

Attention is now directed to FIG. 9 which illustrates a similar, but alternative embodiment of the invention installed within an air tunnel 100 formed in the ship's hull 102 beneath a fuel tank space 103, and in alignment with a discharge opening 104. The apparatus depicted in FIG. 9 includes a pipe section 106 adapted to be coupled, at its upstream end to a source of sea water 108. The down stream end of pipe section 106 is coupled to the inlet of jet pump 110. The jet pump 110 includes a suction chamber housing 112 apertured at 114 to supply air from tunnel 100 to the suction chamber within the housing. Air is supplied to the tunnel from conduit 116.

A pilot pipe 120 is mounted at the end of tunnel 100 adjacent to the discharge opening 104 for supporting the discharge end of jet pump 110. The jet pump is further supported by ring 122 mounted in the center of tunnel 100 by radial struts 124. The upstream end of pipe section 106 is threaded in plate 126 adapted to be bolted to flange 128 welded to the end of the tunnel 100.

An acoustic absorber means 130 is preferably incorporated within the pipe section 106 for attenuating noise produced by the jet pump 110 which would otherwise be transferred upstream along the water supply path. The absorber means includes a series of baffles arranged to absorb acoustic energy while permitting water flow therepast.

From the foregoing, it should be apparent that the present invention provides a novel and useful jet pump and ice lubrication system for ocean going ships. It is recognized that different embodiments of the invention may become obvious to those skilled in the art and the claims associated herewith are intended to include all such embodiments.

What is claimed is:

1. In combination with a ship having a hull and a thruster system including a pipe assembly having an inlet communicating through said hull with the sea and pump means for drawing water through said inlet and selectively discharging said water through first and/or second thruster outlets respectively in the port and starboard sides of said hull, an ice lubrication system comprising:

a first plurality of discharge openings formed in the starboard side of said hull spaced from one another extending toward the stern from the bow portion of said hull;

a second plurality of discharge openings formed in the port side of said hull spaced from one another extending toward the stern from the bow portion of said hull;

a plurality of gas/water mixing devices, each including a converging nozzle mounted adjacent to a different one of said discharge openings;

a conduit having an intake for receiving water from said pump means and an outlet connected to each of said converging nozzles;

each of said nozzles including at least one vane means mounted on the inner surface of the nozzle projecting into the flow path therethrough and oriented to impart a swirl component around the outer boundary of a water column flowing therepast through the nozzle;

a source of nonpressurized gas; each of said gas/water mixing devices including a suction chamber coupled to the nozzle thereof downstream therefrom for creating a mixture of gas and water, each of said chambers having a first inlet communicating with said gas source and second inlet means upstream from said first inlet for receiving said water column exiting from the nozzle coupled thereto whereby said column creates a suction to pull gas through said first inlet into said chamber to entrain said gas in said column outer boundary, and outlet means for discharging said mixture of water and entrained gas through the discharge opening adjacent thereto.

2. The system of claim 1 further including means for heating the gas supplied by said source means to said suction chambers.

3. The system of claim 1 wherein each of said suction chambers includes a drain means for draining water therefrom.

4. The system of claim 1 further including a source of compressed air connected to each of said suction chambers and means for selectively releasing said compressed air into said chambers to remove debris therefrom.

5. In combination with a ship having a hull and pump means for drawing water from the sea through an inlet in said hull, an ice lubrication system for facilitating the passing of said ship through ice laden water, said system comprising:

a first plurality of discharge openings formed in the starboard side of said hull spaced from one another extending toward the stern from the bow portion of said hull;

a second plurality of discharge openings formed in the port side of said hull spaced from one another extending toward the stern from the bow portion of said hull;

a plurality of jet pumps each having a water inlet, a gas inlet, and a gas/water outlet, each of said jet pumps being mounted in said hull with the gas/water outlet thereof adjacent to a different one of said discharge openings;

a source of nonpressurized gas; and conduit means for coupling the outlet of said pump means to said jet pump water inlets for causing each of said jet pumps to produce a gas/water mixture and discharge it through the discharge opening adjacent thereto;

each of said jet pumps comprising:

a pipe section having a throat defined between an upstream converging portion and a downstream diverging portion defining said gas/water outlet and wherein said gas inlet is proximate to said converging portion; and a nozzle means including a converging nozzle mounted substantially concentrically within said pipe section for discharging a water flow therein proximate to said pipe section converging portion for producing a suction at said gas inlet to pull a stream of gas from said source of nonpressurized gas;

said nozzle means including a vortex generating means mounted therein upstream from said converging nozzle, said vortex generating means comprising one or more vanes mounted on the inner periphery of said nozzle means and elongated substantially in the direction of the water flow thereat, each of said vanes defining a surface extending substantially radially inwardly from the inner periphery of said nozzle means and oriented to essentially rotate the outer boundary of said water flow around the direction of flow to create sufficient turbulence to entrain said gas pulled in through said gas inlet to produce a frothy gas/water mixture for discharge through said discharge openings.

6. The combination of claim 5 further including vane means mounted within said pipe section between said gas inlet and said throat for rotating the gas stream pulled through said gas inlet around its primary direction of flow.

7. The combination of claim 5 wherein the dimensions of said vane surfaces extending substantially radially inwardly are sufficiently small to leave an unimpeded central path for passing ice and/or debris.

8. The combination of claim 5 wherein said source of nonpressurized gas supplies ambient air; and further including means for heating the air supplied by said source to a temperature greater than ambient.

9. The combination of claim 5 wherein said discharge openings in the sides of said hull are located below the chine of said ship.

10. The combination of claim 5 wherein said discharge openings in the sides of said hull are located below the chine of said ship; and wherein said gas source means includes a plurality of air holes in the sides of said hull located above said discharge openings; and a plurality of air pipes each connecting one of said air holes to one of said gas inlets.

* * * * *